US010631669B2

(12) United States Patent
Strassburger et al.

(10) Patent No.: US 10,631,669 B2
(45) Date of Patent: Apr. 28, 2020

(54) NECKLACE SECURITY DISPLAY HANGER

(71) Applicant: B&G Plastics, Inc., Union, NJ (US)

(72) Inventors: Jacob Strassburger, South Plainfield, NJ (US); Keith Cedro, Ho Ho Kus, NJ (US); Michael Norman, East Brunswick, NJ (US)

(73) Assignee: B&G Plastics, Inc., Union, NJ (US)

( * ) Notice: Subject to any disclaimer, the term of this patent is extended or adjusted under 35 U.S.C. 154(b) by 0 days.

(21) Appl. No.: 16/250,573

(22) Filed: Jan. 17, 2019

(65) Prior Publication Data

US 2019/0239658 A1 Aug. 8, 2019

Related U.S. Application Data

(60) Provisional application No. 62/625,512, filed on Feb. 2, 2018.

(51) Int. Cl.
*A47F 7/00* (2006.01)
*A47F 7/024* (2006.01)
*A47F 5/00* (2006.01)

(52) U.S. Cl.
CPC ..... *A47F 7/024* (2013.01); *A47F 5/0006* (2013.01)

(58) Field of Classification Search
CPC ..... A47F 7/024; A47F 5/006; A47F 5/0846; A47F 7/02
USPC ..... 248/551, 317; 211/85.2
See application file for complete search history.

(56) References Cited

U.S. PATENT DOCUMENTS

| | | | |
|---|---|---|---|
| 4,714,156 | A | 12/1987 | Kolton et al. |
| 4,765,467 | A | 8/1988 | Kolton et al. |
| 4,768,649 | A | 9/1988 | Kolton et al. |
| 4,930,692 | A | 6/1990 | Smilow et al. |
| 5,110,019 | A | 5/1992 | Kolton et al. |
| 5,123,577 | A | 6/1992 | Kolton et al. |
| 5,222,638 | A | 6/1993 | Kolton et al. |
| 5,328,065 | A | 7/1994 | Kolton et al. |
| 5,501,378 | A | 3/1996 | Kolton et al. |
| 5,582,387 | A | 12/1996 | Kolton et al. |
| 5,615,810 | A | 4/1997 | Kolton et al. |
| 5,826,760 | A | 10/1998 | Kolton et al. |
| 5,988,462 | A | 11/1999 | Kolton |
| 6,073,758 | A | 6/2000 | Webster et al. |
| 6,206,253 | B1 | 3/2001 | Kolton et al. |
| 6,264,077 | B1 | 7/2001 | Kolton et al. |
| 6,561,358 | B2 | 5/2003 | Kolton et al. |

(Continued)

*Primary Examiner* — Steven M Marsh
(74) *Attorney, Agent, or Firm* — Hoffmann & Baron, LLP

(57) ABSTRACT

A necklace security display hanger includes a body member, a closure member, and a base member. A body member has an upper body portion and a lower body portion wherein the lower body portion includes a plurality of locking parts and a first claw having a first claw opening at a distal end. A closure member has an upper closure portion, a lower closure portion, and an offset between the upper and lower closure portions wherein the lower closure portion includes a plurality of locking apertures and a second claw having a second claw opening at a distal end. When the plurality of locking parts are engaged with the plurality of locking apertures, tips of the second claw are positioned immediately next to tips of the first claw such that an enclosed hole is defined by the first and second claw openings of the first and second claws.

20 Claims, 6 Drawing Sheets

(56) References Cited

U.S. PATENT DOCUMENTS

| | | | | |
|---|---|---|---|---|
| 6,905,024 | B1 * | 6/2005 | Cao | A47F 5/0861 206/1.5 |
| 7,143,892 | B2 | 12/2006 | Kolton et al. | |
| 7,448,520 | B2 | 11/2008 | Kolton et al. | |
| 8,286,882 | B2 | 10/2012 | Norman et al. | |
| 8,308,291 | B2 | 11/2012 | Norman et al. | |
| 8,651,344 | B2 | 2/2014 | Norman et al. | |
| 9,480,347 | B2 | 11/2016 | Strassburger et al. | |
| 9,585,496 | B2 | 3/2017 | Strassburger et al. | |
| 2002/0117595 | A1 * | 8/2002 | Bierjon | B60Q 1/0441 248/551 |
| 2016/0058209 | A1 | 3/2016 | Strassburger et al. | |
| 2017/0253408 | A1 * | 9/2017 | Strassburger | G08B 13/2434 |
| 2018/0087293 | A1 | 3/2018 | Strassburger et al. | |

* cited by examiner

NECKLACE SECURITY DISPLAY HANGER

CROSS-REFERENCE TO RELATED APPLICATION

This application claims priority to U.S. Provisional Patent Application No. 62/625,512, filed on Feb. 2, 2018, the contents of which are incorporated herein by reference in its entirety.

FIELD OF THE INVENTION

The present invention relates to necklace display hangers, and more particularly, to necklace display hangers with a theft deterrent locking mechanism.

BACKGROUND OF THE INVENTION

Small articles, such as necklaces, are commonly displayed for sale in retail stores on racks or in display cases where the articles are hung. A variety of different hangers and tags have been used to secure necklaces and to be suspended on a hook or the like, such as a pegboard hook for retail display. Because of necklace's relative small size, it is hard to track each of them and can easily be stolen by consumers without security tags. These security tags can be enclosed in or attached to a variety of different devices, such as holders or housing, which accommodate the electronic tag and are used to attach the tags to article. However, the security tags present both manufacturing and assembling issues, which increase the cost and product complexity.

Accordingly, there is a need for an improved necklace display hanger to prevent theft of the article by consumers, as well as simple cost efficient to manufacture.

SUMMARY OF THE INVENTION

According to an embodiment of the present invention, a necklace security display hanger for securing a necklace thereon includes a body member, a closure member, and a base member extending from the body member and connecting the body member and the closure member. A body member has an upper body portion and a lower body portion wherein the lower body portion includes a plurality of locking parts and a first claw having a first opening at a distal end. A closure member has an upper closure portion, a lower closure portion, and an offset between the upper and lower closure portions wherein the lower closure portion includes a plurality of locking apertures and a second claw having a second opening at a distal end. When the plurality of locking parts are engaged with the plurality of locking apertures, tips of the second claw are positioned immediately next to tips of the first claw such that an enclosed hole is defined by the first and second openings of the first and second claws.

These and other aspects of the present invention will be better understood in view of the drawings and following detailed description.

DETAILED DESCRIPTION OF PREFERRED EMBODIMENTS

Figure 1:
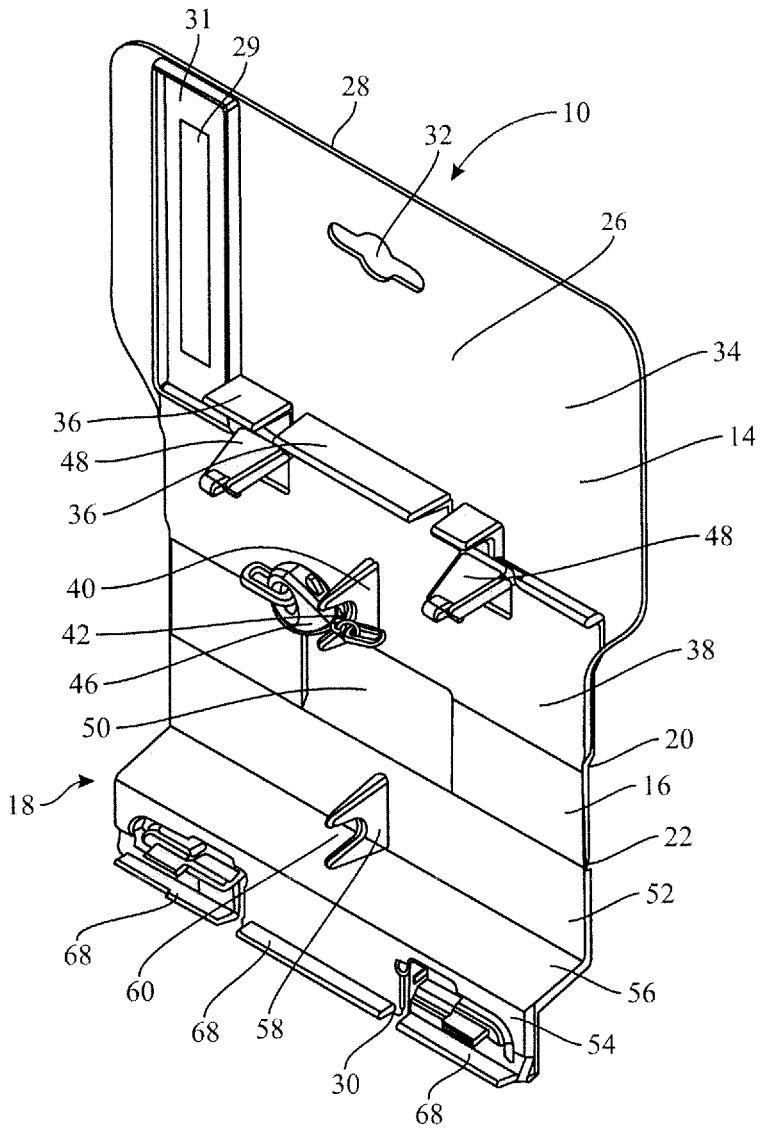
FIG. 1 is a perspective rear view of the necklace security display hanger, according to an embodiment of the present invention, in an unlocked/open position.
Figure 2:
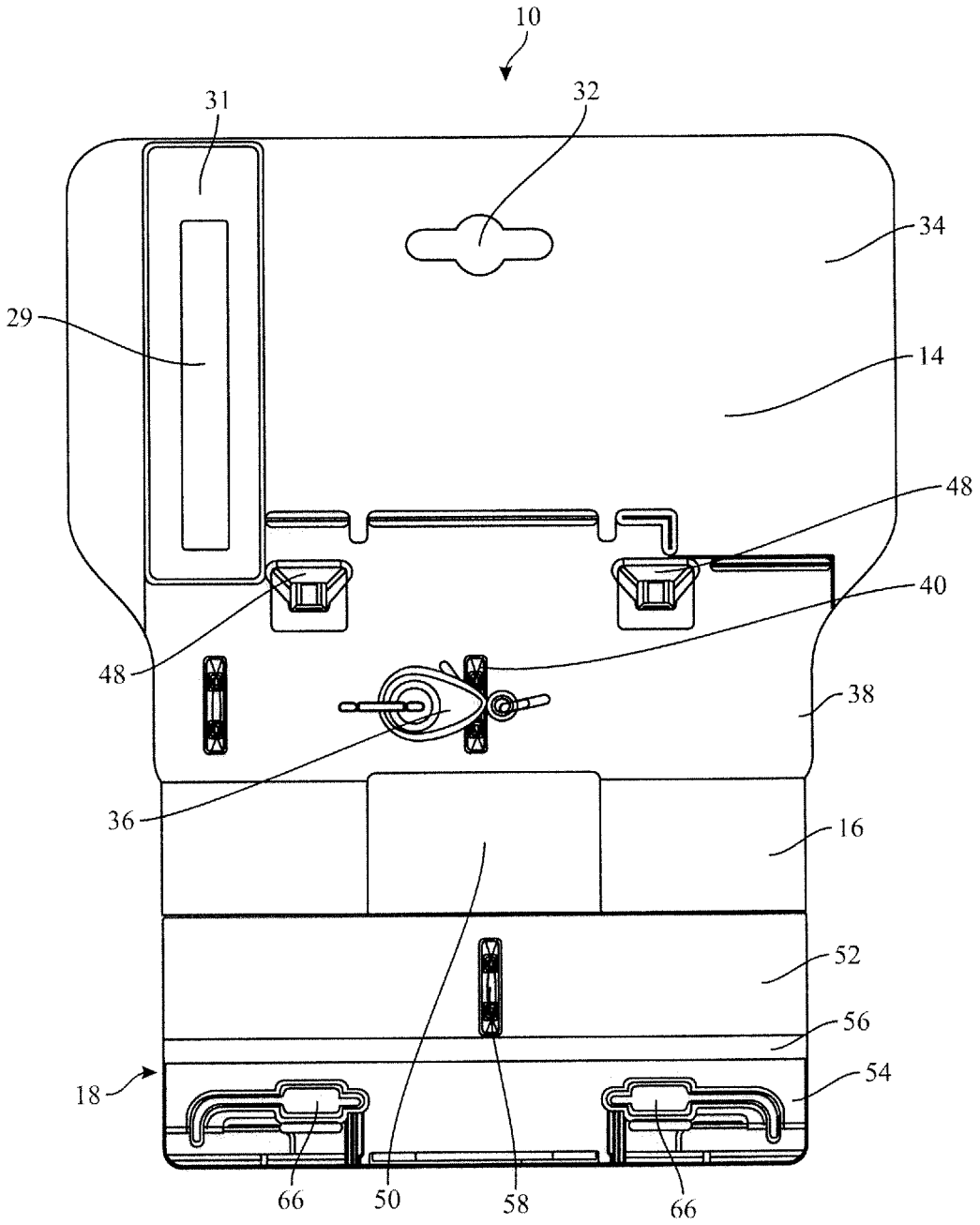
FIG. 2 is a rear view of the necklace security display hanger in FIG. 1.

According to an embodiment of the present invention, referring to FIG. 1, there is shown a necklace security display hanger 10 designed and configured to secure a necklace thereonto. The necklace security display hanger 10 has a one-piece structure and includes a body member 14, a base member 16, and a closure member 18. The necklace security display hanger 10 further includes first and second foldlines 20, 22, such as crease, that are defined between the body and base members 14, 16 and between the base and closure members 16, 18, respectively. The first and second foldlines 20, 22 define a boundary between the body and base members 14, 16 and a boundary between the base and closure members 16, 18, respectively, allowing the base and closure members 16, 18 to be movable along the foldlines 20, 22 to transition the necklace security display hanger 10 between unlocked/open (FIGS. 1 and 2) and locked/closed positions (FIGS. 3-6). In the locked/closed position, the closure member 18 of the necklace security display hanger 10 engages with the body member 16 to tightly secure the necklace to the necklace security display hanger 10 to prevent theft by customers, as will be described in greater detail below.

Directional terms, such as front, rear, bottom, upper, and lower are referenced to an orientation in which the locked necklace security display hanger 10 is hung on a display hook/rod with the closure member 18 of the necklace security display hanger 10 facing backward. However, the present invention is not thereby limited to use in any particular orientation.

Referring to FIGS. 1-5, the body member 14 has a front surface 24 and a rear surface 26 extending between first and second ends 28, 30. The front and rear surfaces 24, 26 of the body member 14 may be utilized for pictures such as logos, text (including product descriptions), and pricing information to be printed on, embossed in, or otherwise attached. In addition, as shown in FIG. 1, a security tag 29, e.g., a radio frequency identification (RFID) tag or the like, may be applied to a tag portion 31 defined on the rear surface 26 of the body member 14. Alternately, the security tag 29 could be applied on the front surface 24 of the body member 14. The security tag 29 may be applied in any fashion and may even be concealed on the body member 14.

The security tag 29 attached to the necklace security display hanger 10 has a wide variety of uses, including tracking, inventory control, and security. The security tag 29 can also provide electronically readable information pertaining to the necklace. The security tag 29 is firmly secured onto the body member 14 such that it remains with the necklace until after the time of purchase.

A display aperture 32 is defined in an upper body portion 34 of the body member 14 for engaging the necklace security display hanger 10 with a display hook/rod for retail display. In addition, a plurality of body tabs 36 are formed integrally from the rear surface 26 of the body member 14 and extend perpendicularly therefrom.

Referring again to FIGS. 1 and 2, in a lower body portion 38 of the body member 14, a first claw 40 is formed integrally from the rear surface 26 of the body member 14 and extends perpendicularly therefrom with a first claw opening 42 at a distal end for receiving/holding a part of a necklace clasp 46, as will be describe in greater detail below.

A plurality of locking parts 48 are also formed integrally from the rear surface 26 of the body member 14 above the first claw 40 and extends perpendicularly therefrom with each of the plurality of locking parts 48 separated by a predetermined distance. The plurality of locking parts 48 are designed and configured to be engaged and inserted through corresponding locking aperture to provide a locking mechanism to prevent the necklace from being removed from the necklace security display hanger 10, as will be described in greater detail below. In the depicted embodiment, the necklace security display hanger 10 includes a pair of locking parts 48; however, the locking parts 48 may be defined as many as deemed necessary.

The base member 16 is substantially flat and has a rectangular base aperture 50 defined thereon. The base member 16 extends from the second end 30 of the body member 14 and connects the closure member 18 to the body member 14. When the necklace display hanger 10 is in the locked/closed position (FIGS. 3-6) and fully assembled with a part of the necklace trapped inside the necklace display hanger 10, the base aperture provides 50 an opening for the necklace to be suspended therethrough and below the base member 16 of the necklace security display hanger 10.

Referring again to FIGS. 1 and 2, the closure member 18 extends from the base member 16 and includes an upper closure portion 52, a lower closure portion 54, and an offset 56 between the upper and lower closure portions 52, 54. Specifically, the upper closure portion 52 and the lower closure portions 54 are separated and connected via the offset 56 with an angle relative thereto, as shown in FIG. 1.

Figure 5:
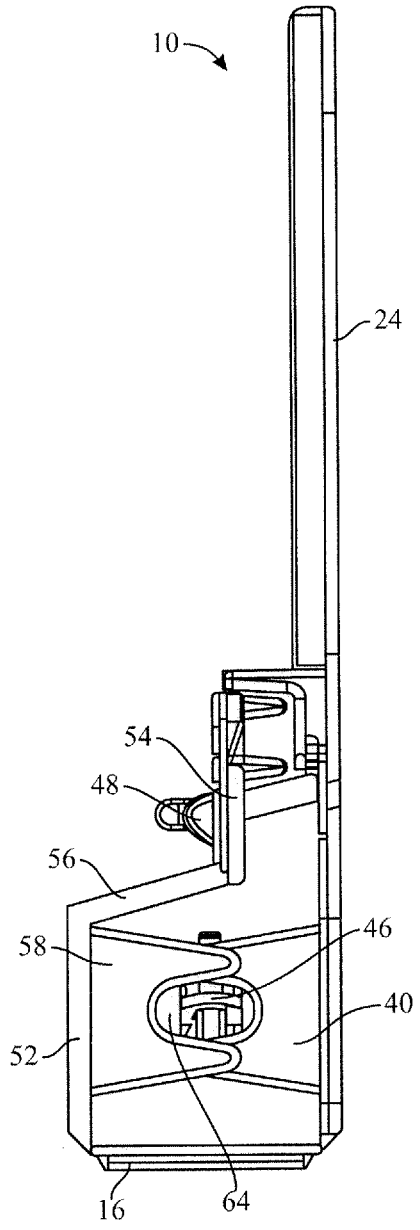
FIG. 5 is a side view of the necklace security display hanger in FIG. 3.
Figure 6:
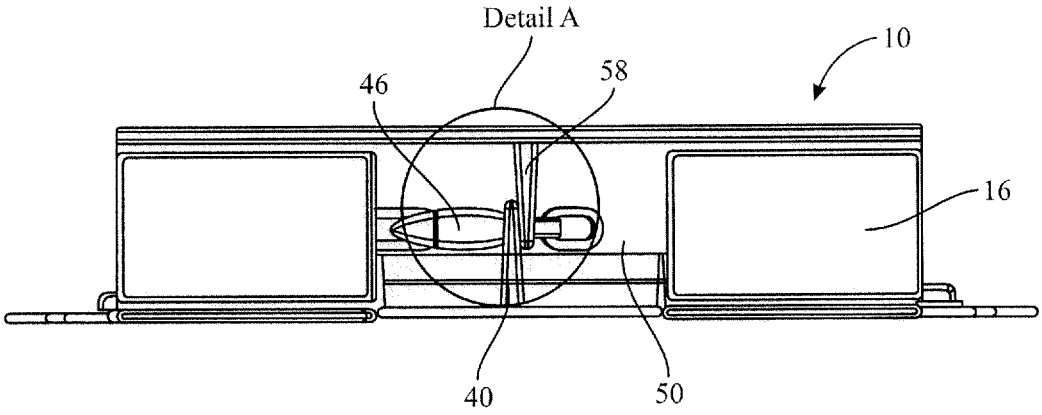
FIG. 6 is a bottom view of the necklace security display hanger in FIG. 3.
Figure 7:
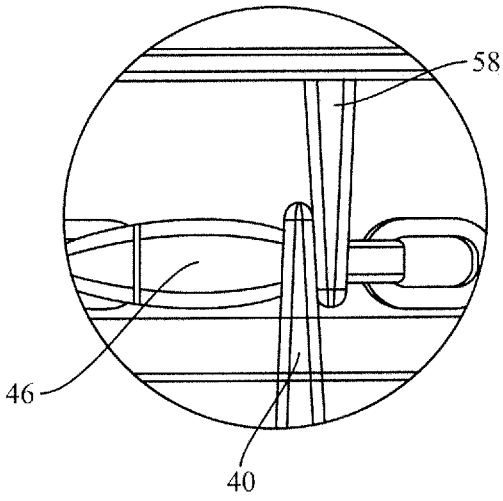
FIG. 7 is a view of Detail A in FIG. 6.

A second claw 58 is formed integrally from the upper closure portion 52 and extends perpendicularly therefrom with a second claw opening 60 at a distal end for receiving/holding the part of the necklace clasp 46. More specifically, the first claw 40 and the second claws 58 are designed and configured such that, when the necklace display hanger 10 is in the locked/closed position, tips of the second claw 58 are positioned immediately next to tips of the first claw 40, thereby defining an enclosed hole 64 with the first and second claw openings 42, 60 of the first and second claws 40, 58, as shown in FIGS. 5-7. The enclosed hole 64 allows the part of the necklace clasp 46 to be placed and trapped therewithin such that the necklace can be suspended and secured onto the necklace security display hanger 10 without being separated.

Figure 3:
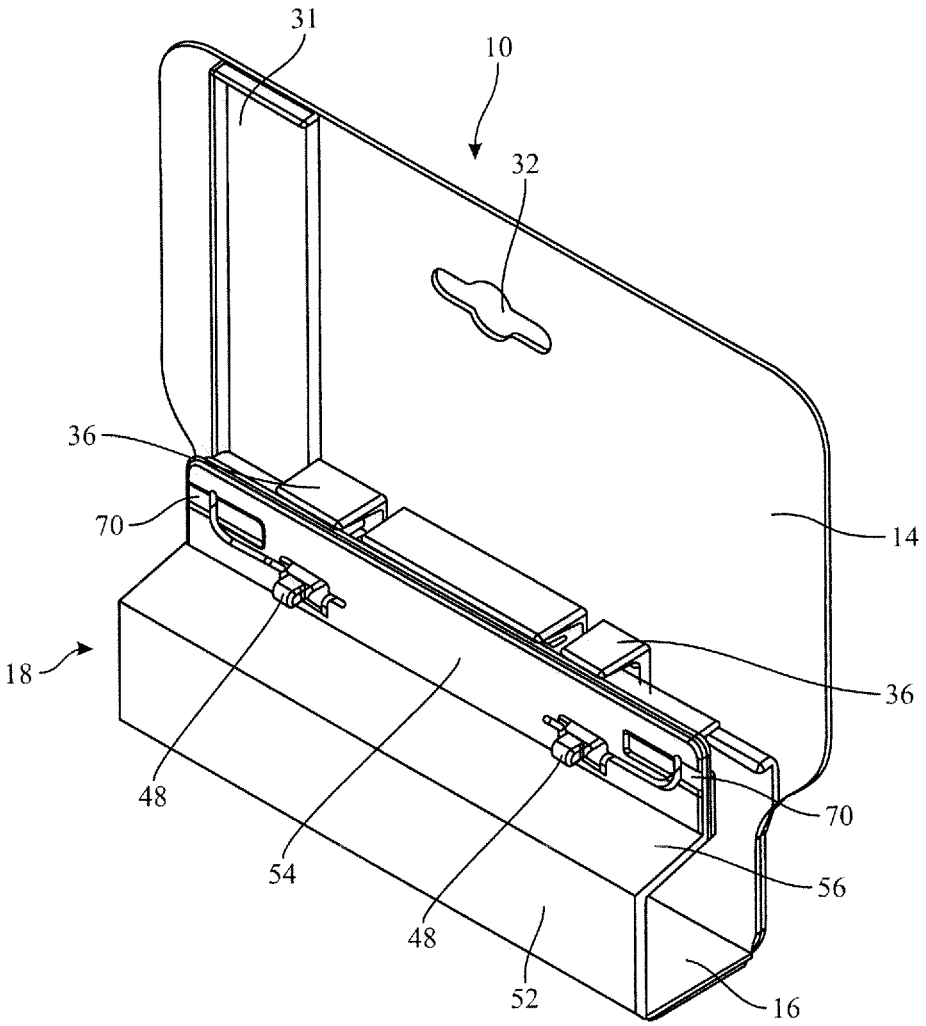
FIG. 3 is a perspective rear view of the necklace security display hanger in FIG. 1 in a locked/closed position.
Figure 4:
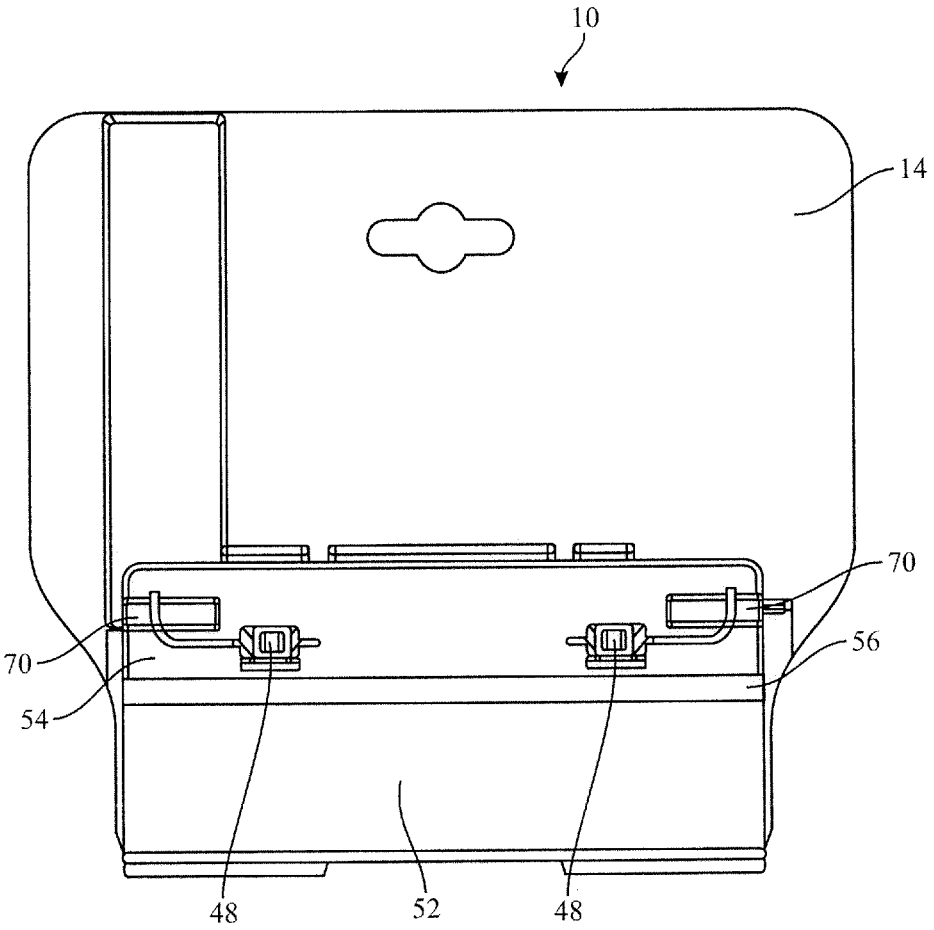
FIG. 4 is a rear view of the necklace security display hanger in FIG. 3.

A plurality of locking apertures 66 are defined in the lower closure portion 54 of the closure member 18 through which the corresponding locking parts 48 can be inserted. Contours of the plurality of locking parts 48 and the plurality of locking apertures 66 are configured such that, when engaged, they collectively provide a locking mechanism, with each tip of the plurality of locking parts 48 protruding outwardly from the each corresponding locking aperture 66, as illustrated in FIGS. 3-5. In addition, a plurality of closure member tabs 68 are integrally formed from the bottom of the lower closure portion 54. The plurality closure member tabs 68 are configured such that, when the necklace display hanger 10 is in the locked/closed position, the plurality of closure member tabs 68 are arranged in a space defined between the plurality of body tabs 36 and the plurality of locking parts 48.

Once the necklace security display hanger 10 is in the locked/closed position, it is extremely difficult to open it with bare hands to separate the necklace from the necklace security display hanger 10. In fact, the locked necklace security display hanger 10 is not readily openable without destruction of the hanger 10. The necklace can be separated from the locked necklace security display hanger 10 by cutting the closure member 18 along a plurality of cut tabs 70 defined on the lower closure portion 54 of the closure member 18.

The necklace security display hanger 10 is made of one or more materials having suitable properties for a desired application, including strength, weight, rigidity, etc. Plastic is generally preferred.

In use of the necklace security display hanger 10, first, in the unlocked/open position, the part of the necklace clasp 46 is placed within the first claw 40 of the body member 14. Then, by folding the base member 16 and the closure members 18 along the first foldline 20 and the second foldline 22 and closing the closure member 18 by locking it via the plurality of locking parts 48, tips of the second claw 58 of the closure member 18 are positioned immediately next to tips of the first claw 40 to trap the part of the necklace clasp 46 therebetween. The necklace security display hanger 10 is now ready for suspension on a display hook or the like, such as a pegboard hook for retail display. Once a consumer purchases the necklace, the consumer can remove it from the necklace security hanger display 10 by cutting or clipping each tip of the plurality of locking parts 48 or the plurality of cut tabs 70 to allow the closure member 18 to be open.

From the foregoing, it will be appreciated that a necklace display hanger according to the present invention may be used for anti-theft, tracking and inventory control, while providing the design that is convenient for merchants to display their goods.

In general, the foregoing description is provided for exemplary and illustrative purposes; the present invention is not necessarily limited thereto. Rather, those skilled in the art will appreciate that additional modifications, as well as adaptations for particular circumstances, will fall within the scope of the invention as herein shown and described and of the claims appended hereto.

What is claimed is:

1. A necklace security display hanger for securing a necklace thereon, the necklace security display hanger comprising:

a body member having an upper body portion, a lower body portion, a front surface, and a rear surface, wherein the lower body portion includes a plurality of locking parts and a first claw having a first claw opening at a distal end;

a closure member having an upper closure portion, a lower closure portion, and an offset between the upper and lower closure portions, wherein the lower closure portion includes a plurality of locking apertures and a second claw having a second claw opening at a distal end; and a base member extending from the body member and connecting the body member and the closure member, wherein, when the plurality of locking parts are engaged with the plurality of locking apertures, tips of the second claw are positioned immediately next to tips of the first claw such that an enclosed hole is defined by the first and second claw openings of the first and second claws.

2. The necklace security display hanger of claim 1, wherein the enclosed hole allows a part of a necklace clasp of the necklace to be placed and trapped therewithin such that the necklace can be suspended and secured onto the necklace security display hanger.

3. The necklace security display hanger of claim 1, further comprising a first foldline and a second fold line that are defined between the body and base members and between the base and closure members, respectively.

4. The necklace security display hanger of claim 3, wherein the first and second foldlines allow the base and closure members to be movable along the foldlines to transition the necklace security display hanger between unlocked/open and locked/closed positions.

5. The necklace security display hanger of claim 3, wherein the first and second foldlines define a boundary between the body and base members and a boundary between the base and closure members, respectively.

6. The necklace security display hanger of claim 1, wherein a base aperture is defined on the base member for providing an opening for the necklace to be suspended therethrough and below the base member of the necklace security display hanger.

7. The necklace security display hanger of claim 1, wherein contours of the plurality of locking parts and the plurality of locking apertures are configured such that, when engaged, they collectively provide a locking mechanism and transitions the necklace security display hanger to a locked/close position, with each tip of the plurality of locking parts protruding outwardly from each corresponding locking aperture.

8. The necklace security display hanger of claim 1, wherein a plurality of body tabs are formed from the rear surface of the body member and extend perpendicularly therefrom.

9. The necklace security display hanger of claim 1, wherein a plurality of cut tabs are defined in the lower closure portion of the closure member such that the locked necklace security display hanger can be opened by cutting along the plurality of cut tabs.

10. The necklace security display hanger of claim 8, wherein a plurality of closure hooks are integrally formed from a bottom of the lower closure portion.

11. The necklace security display hanger of claim 10, wherein, when the necklace display hanger is in the locked/closed position, the plurality of closure hooks engage with the plurality of body tabs such that each of the plurality of body tab is disposed within the corresponding closure hook.

12. The necklace security display hanger of claim 1, wherein the upper and lower closure portions are separated and connected via the offset with an angle relative thereto.

13. The necklace security display hanger of claim 1, wherein a display aperture is defined in the upper body portion of the body member for retail display.

14. The necklace security display hanger of claim 6, wherein the base aperture is rectangular.

15. The necklace security display hanger of claim 1, further comprising a security tag.

16. The necklace security display hanger of claim 15, wherein the security tag is attached to one of the front and rear surfaces of the body member.

17. The necklace security display hanger of claim 15, wherein a tag portion is defined on one of the front and rear surfaces of the body member.

18. The necklace security display hanger of claim 17, wherein the security tag is attached and disposed within the tag portion.

19. The necklace security display hanger of claim 15, wherein the security tag is used for tracking, inventory control and security.

20. The necklace security display hanger of claim 15, wherein the security tag is a radio frequency identification (RFID) tag or an electronic article surveillance (EAS) device.

* * * * *